United States Patent [19]

Monaco et al.

[11] 4,029,556

[45] June 14, 1977

[54] PLATING BATH AND METHOD OF PLATING THEREWITH

[76] Inventors: Emlee Monaco; Pasquale F. Monaco, both of 5925 W. 130th St., Cleveland, Ohio 44130

[22] Filed: Oct. 22, 1975

[21] Appl. No.: 624,671

[52] U.S. Cl. ..... 204/40; 204/43 S
[51] Int. Cl.[2] ..... C25D 3/60; C25D 5/10
[58] Field of Search ..... 204/43 S, 43 T, 43 R, 204/123, 120, 122, 40

[56] References Cited

UNITED STATES PATENTS

| | | | |
|---|---|---|---|
| 3,881,919 | 5/1975 | Hyner et al. | 75/175 R |
| 3,914,160 | 10/1975 | Fueki et al. | 204/43 S |

OTHER PUBLICATIONS

Frederick A. Lowenheim, "Modern Electroplating", pp. 433–435, (1963).
Abner Brenner, "Electrodeposition of Alloys", vol. II, pp. 188–189, (1963).

*Primary Examiner*—G. L. Kaplan
*Attorney, Agent, or Firm*—Meyer, Tilberry & Body

[57] ABSTRACT

There is provided an aqueous acidic plating bath for electrodepositing of a tarnish resistant alloy onto an electrically conductive substrate. This bath comprises compounds including metallic plating ions of cobalt, tin and a third metal taken from the class consisting of Periodic Group IVb metals and Periodic Group Vb metals, and combinations thereof. The resulting alloy deposit has general physical properties of a decorative chromium deposit and is an effective substitute therefor.

26 Claims, No Drawings

PLATING BATH AND METHOD OF PLATING THEREWITH

BACKGROUND OF INVENTION

This invention relates to the art of plating and more particularly to an improved aqueous acidic plating bath, method of using the same and resulting plated alloy.

The invention is particularly applicable for barrel plating of small parts, such as screws, washers, bolts, etc., which have been first coated with a bright substrate of nickel, and it will be described with particular reference thereto; however, it is appreciated that the invention has broader applications and may be used for depositing an alloy onto various metal substrates of various small parts or workpieces.

For some time, it has been somewhat standard practice to electolytically deposit chromium over bright metallic substrates or coatings, such as nickel, to provide a tarnish resistant, bright surface on small parts, such as screws, bolts, washers, etc. This chromium finish was not only decorative, but also protected the part from corrosion. Chromium plating is a relatively complex plating procedure which is quite expensive, especially for relatively small parts. In a chromium process, the parts must be scattered on a tray in a single layer and passed through the electrolytic plating bath at a controlled rate. If the parts have been handled or engage each other, there is a tendency to create a defect which must be visually inspected and discarded or stripped and reprocessed. Because of the demands for excellence in chromium finishing, and the lengthy procedure for applying the chromium finish, a substantial amount of time and effort is required to plate the relatively small parts with the normal plating procedure. Only relatively small quantities of these parts can be plated on the standard plating tray which requires a substantial amount of part handling and post-plating inspection. A chromium line for small parts requires a high amount of energy per part and the required equipment involves a substantial capital investment which is difficult to recover when small parts are being plated. This is especially true in the highly competitive field of plating small parts for the automotive trade. For these reasons, there has been a substantial effort to develop a substitute for the basic chromium protective and decorative coating which does not have the extensive economic burdens of chromium plating high volumes of small parts. Such a substitute process must have a somewhat close appearance to the blue-white color of chromium. One attempt to accomplish a substitute for chromium has been the use of a binary alloy of cobalt and tin. Such an alloy was found to lack the protective qualities of a chromium finish under certain circumstances. In addition, a cobalt-tin binary alloy would not generally have the same degree of abrasion resistance as chromium. Because of these deficiencies in a cobalt and tin binary alloy, there has still been a substantial demand for a true substitute for chromium. One ternary type of alloy has been suggested using indium, zinc or chromium with cobalt and tin. This type of plating system has many of the disadvantages of prior chromium plating.

THE INVENTION

The present invention relates to an improved alloy to be used as a substitute for bright chromium which has an appearance quite similar to chromium, an excellent tarnish resistance, is uniform and consistent in color, can be easily applied to small parts and provides adequate abrasion resistance to the parts. In accordance with the present invention, there is provided an aqueous acidic plating bath for electrodepositing a tarnish resistant alloy onto an electrically conductive substrate, which bath comprises compounds including metallic plating ions of cobalt, tin and a third metal selected from the class consisting of Periodic Group IV*b* metals and Periodic Group V*b* metals.

Yet a further aspect of the present invention is the provision of a method for bulk plating of the outer surfce of small parts forming a randomly-oriented agglomeration, wherein each dimension of the agglomeration of parts is substantially greater than any dimension of the constituent parts of the agglomeration. These parts to be plated are freely movable with respect to each other when the agglomeration is tumbled during the plating process. This method comprises the steps of placing the agglomeration of parts in a plating barrel, placing the barrel into an aqueous acidic bath including dissociated ionic compounds of tin, cobalt and a third metal selected from the Periodic Groups IV*b* and V*b*, placing a first electrode into the agglomeration of parts, placing a second electrode in the acidic bath, energizing the electrodes to plate an alloy onto the surfaces of the small parts, and rotating the barrel during the energizing step.

By using the present invention, which is set forth generally above, the plating metal forms a substitute for chromium and may be employed in a bulk finishing process using plating barrels. As is well known, finishing of small parts in such a bulk process is more economical than the plating of chromium on trays and other similar slow individualized plating systems. Bulk chromium plating processes are inherently low in volume, require substantial manpower, and are expensive because of rejects. In addition, chromium processes which are replaced by the present process and alloy, could not be used when the parts have odd or irregular geometrical shapes. Bulk chromium plating of such parts is quite difficult and time consuming. The chromium process does not have a high throw to evenly coat the various geometrical shapes.

In summary, by using the present invention, small parts can be bulk plated in barrels and similar plating receptacles to provide a finish which approximates chromium. In this manner, a quantity of parts which would require approximately six hours and three men to process in a standard chromium finishing line can be processed in approximately twenty minutes by a single man. This is a substantial advance over the chromium processing procedure to obtain a bright, corrosion resistant, abrasive resistant coating over small parts. By using the present invention, the small parts may be processed in a plating barrel as an agglomeration of small parts which can be tumbled and exposed to electrodes of the dangler type. Thus, bulk processing of small parts which is not practical for chromium procedure and other bright plating procedures can be used when employing the present invention. This drastically reduces the manpower, cost and lead time for producing a coating having the attributes of a chromium deposit.

In accordance with one aspect of the invention, more than one electrode is introduced into the agglomeration of small parts in the processing operation. In this manner, there is provided even distribution of the current through the various tumbled small parts in the barrel.

By using the present invention, the bath itself tends to remove any surface imperfection such as slight rust or tarnish. Thereafter, an alloy is deposited onto the clean surface to produce a protective covering over the substrate forming the surface of the individual small parts being plated. No organic brighteners are required. In accordance with one aspect of the present invention, a bright nickel deposit is first plated onto the small parts in accordance with any normal bright nickel plating process. This is done in a barrel and does not require the individual attention and removal and transfer of the nickel plated parts to the tray type processing generally employed in a chromium line. This prior bright nickel substrate applied to the parts before being introduced into a bath formulated in accordance with the present invention, imparts the brightness to the resulting part. Thus, to produce a bright part, a bright nickel substrate is deposited in accordance with known bright nickel plating procedures prior to plating in the bath of the present invention. The present bath is considered non-leveling which indicates that it essentially coats the surface without smoothing the surface. Thus, by first producing a bright nickel substrate, a bright resulting finish is imparted to the parts by the deposit from the bath of the present invention. Of course, other procedures could be incorporated for brightening the surface of the parts preparatory to introducing the parts into the bath of the present invention. Other bright metal deposits could be used for brightening or, alternatively, mechanical brightening of the parts could be employed. In addition, it is conceivable that some parts, such as brass screw machine parts, are sufficiently bright after being cleaned to accept the deposit of the present invention and produce a bright, chromium-like surface.

The primary object of the present invention is the provision of an improved coating for small parts which has a bright appearance which duplicates the blue-white appearance of chromium and has adequate tarnish resistance, uniformity and abrasion resistance.

Still a further object of the present invention is to provide a new electrolytic plating process or method which employs a deposit which has a bright decorative appearance similar to chromium and with adequate tarnish resistance and abrasion resistance.

Still a further object of the present invention is the provision of a, process and bath which can be used to produce a surface on small, bulk-finished parts wherein the surface is a plated layer having the properties of chromium without the cost and time required for chromium plating.

Still a further object of the present invention is the provision of a, bath and process for plating small parts in a barrel operation which parts, when plated, have an appearance and physical properties similar to chromium.

Still a further object of the present invention is the provision of a bath and process as set forth above which utilize a bath having ions of cobalt, tin, and a third metal selected from Periodic Groups IV*b* or V*b*. These third metals include zirconium, niobium, tantalum, hafnium, titanium, and vanadium of which tantalum and vanadium are preferred. In accordance with one aspect of the invention, the addition of a small amount of ferric ions can be used to enhance the effects of the foregoing third metals.

Still a further object of the present invention is the provision of a bath and plating process which employ an aqueous, acidic bath containing stannous ions, cobaltous ions, ions of one or more metals of Periodic Groups IV*b* or V*b* and suitable anions to produce a bright alloy deposit of desired physical properties with a color similar to decorative chromium while avoiding the use of an organic brightener or additives which complicate plating procedures and often introduce undesirable reduction products into the bath.

PREFERRED EMBODIMENT

The invention pertains to a bath for depositing an alloy on small parts in a barrel type plating process, together with the resulting alloy and the process for plating small parts in such a bath. Initially, the properties of the bath will be disclosed together with certain features of the process which, taken together, will describe the invention defined in the claims of this application.

The bath or solution used for the deposition of the inventive deposit is an aqueous bath having a preferred pH of about 2.0. The acidic bath has a pH in the general range of 1.0 to 4.2. The acids which are generally used for pH control are hydrochloric acid, hydrofluoric acid and fluoboric acid, since these acids are common with the anions of the metal ion producing compounds used as source of the three basic metals to be deposited from the bath. Although acids may be used for pH control, as will be described later, this invention relates to a method of formulating a bath which does not require the use of dangerous and obnoxious acids and/or corrosive alkalis. If acid is used in the bath of the invention, the preferred acid is hydrochloric acid since chlorides are preferred as the source of cobalt and tin in the plating bath.

The metals to be plated electrolytically from the bath are present as free metallic ions and complex ions. The composition of the bath is formulated so that with the proper electrode arrangement and a cathode current density of about 5–65 Amps per Sq. Ft., preferably 5–45 Amps per Sq. Ft., an alloy containing cobalt and tin will be deposited from the bath onto parts in the bath with the parts having desirable characteristics resembling chromium. It is preferred that the metal compounds, i.e. the metal ion producing compounds, of the bath be chlorides, fluorides or fluoborates, but it is understood, of course, that other anion compounds may be suitable, such as sulfates and sulfamates. The anion compound may influence the acid used when pH control is by addition of an acid. The preparation and formulation of the baths is in accordance with standard plating practice and basically no special precautions are necessary, except those that a person trained in the plating art would normally follow. A typical chloride-fluoride type bath, in accordance with the invention, would have effective concentration ranges as follows:

| GENERAL COMPOUNDS OF BATH | | | |
|---|---|---|---|
| Cobalt Chloride | about | 100–350 | gr/liter |
| Stannous Chloride | about | 5–45 | gr/liter |
| Vanadium Fluoride | about | 2–60 | gr/liter |
| Ammonium Bifluoride | about | 35–75 | gr/liter |
| Ammonium Chloride | about | 70–100 | gr/liter |

The resulting deposit has the blue white appearance of chromium and retains the bright appearance of nickel.

The vanadium fluoride may be replaced by a similar compound of other Periodic Group IV*b* or V*b* metals, preferably tantalum, zirconium, and niobium. When these metals are employed in the bath formulation as a fluoride, about 0.2–8 gr/liter of tantalum fluoride, about 1.0–35 gr/liter of zirconium fluoride or about 2.0–25 gr/liter of niobium fluoride are employed. Consequently, the third metal compounds have a concentration in the inventive bath of about 0.2–60 grams per liter. Although fluorides of the third metals are preferred in the general compostion of the bath, chlorides, sulfamates, and fluoborates are satisfactory substitutes. All of these anion compounds can be used for the cobalt and tin compounds although the chloride, fluoborate and sulfamate of cobalt and the chloride and fluoborate of tin are preferred.

It is possible to arrive at the inventive formulation set forth above by using ammonium hydroxide and hydrochloric acid according to Clarke et al, "Transactions of the Institute of Metal Finishing" 1972 Vol. 50; but it is preferred to avoid the use of these somewhat obnoxious materials by using ammonium chloride, a white crystalline material which has the appearance of table salt and no odor or corrosive characteristics. When the metal tin and cobalt compounds are fluoborates it is preferred to use ammonium bifluoride and ammonium chloride to achieve correct formulation and pH rather than strong acids or ammonia. The third metals are used as chlorides, fluorides or other soluble salts and in about the same concentration. When it is desirable to have ferric ion present, ferric chloride can be used at a concentration of about 0.50–6.0 grams per liter in the bath, or about 0.3–2.0 grams per liter of ferric ions in the bath.

Generally the composition of the alloy plated onto a part in the bath will vary with concentration of the metals in the plating bath, together with such physical variables as temperature, current density, etc. In this invention it is of the utmost importance to control these variables within a range suitable for electrodeposition of a bright chromium-like deposit on the substrate, which is preferably bright nickel. Generally, operation and control of the plating process needs no detailed description as they are well known in the art. For example, it is a well known practice in the electroplating art to passivate the surfaces of zinc, cadmium and tin with various aqueous chromate or chromic acid conversion coating dips. This treatment considerably enhances the tarnish and corrosion resistance of the protective metal coating. Since the alloys of this invention are largely tin in composition it would be expected that such a treatment would be beneficial and is used in practice.

Plating baths according to the invention need no other additives such as organic brighteners. Surfactants are not usually needed, but if these are used they should be of the inert fluorocarbon type. The whole point of these new alloys is to replace decorative chromium and therefore they would ordinarily be deposited over bright nickel. They do, however, plate very well over copper, steel or brass.

The following are typical examples of plating baths suitable for the deposition of inventive alloys, but it is not intended that they limit the scope of the invention except as stated in the appended claims.

EXAMPLE I

| | | |
|---|---|---|
| Cobalt Chloride | 50–350 | gr/liter |
| Stannous Chloride | 5–45 | gr/liter |
| Vanadium Fluoride | 1–45 | gr/liter |
| Ammonium Bifluoride | 35–75 | gr/liter |
| Ammonium Chloride | 70–100 | gr/liter |
| Temperature | 55–80° C | |
| pH | Approx. 2.0 | |
| Current density | 5–45 Amp/ft² | |

EXAMPLE II

| | | |
|---|---|---|
| Cobalt Chloride | 50–350 | gr/liter |
| Stannous Chloride | 5–45 | gr/liter |
| Vanadium Fluoride | 2–45 | gr/liter |
| Ferric chloride | 0.5–4.0 | gr/liter |
| Ammonium Bifluoride | 35–75 | gr/liter |
| Ammonium Chloride | 70–100 | gr/liter |
| Temperature | 55–80° C | |
| pH | Approx. 2.0 | |
| Current Density | 5–45 Amp/ft² | |

EXAMPLE III

| | | |
|---|---|---|
| Cobalt Chloride | 50–350 | gr/liter |
| Stannous Fluoborate (50%) | 10–45 | gr/liter |
| Tantalum Fluoride | 0.2–8 | gr/liter |
| Ammonium Bifluoride | 35–75 | gr/liter |
| Ammonium Chloride | 70–100 | gr/liter |
| Temperature | 55–80° C | |
| pH | Approx. 2.0 | |
| Current Density | 5–45 Amp/ft² | |

PLATING METHOD

In accordance with the method of using the bath formulated in accordance with the present invention, a plurality of small parts, such as screws, bolts, nuts, etc., are first bright nickel plated in a barrel process in accordance with normal bright nickel barrel plating techniques. These parts are then placed in a tumbler or barrel so that the parts form a randomly-oriented agglomeration. Although this agglomeration is well known in the bulk plating art, it can be defined as including dimensions in all directions which are substantially greater than any dimension of the constituent parts of the agglomeration. Each of the parts is freely moveable relative to each other when the agglomeration or bulk is rotated or tumbled by the rotation of the barrel. After the parts are placed in a barrel and form the aforedescribed agglomeration, the barrel is placed in an aqueous acidic bath of the type formulated in accordance with the present invention which includes electrolytic compounds of tin, cobalt and a third metal selected from the Periodic Groups IV*b* and V*b*. Thereafter, appropriate electrodes are used in the acidic aqueous bath. In accordance with the preferred embodiment, the barrel holding the parts is elongated and rotatable about its elongated axis. Two or more dangling electrodes are provided within the barrel and extend downwardly into the agglomeration of parts. In practice, four electrodes are somewhat equally spaced axially along the inner surface of the barrel to provide even distribution of current through the agglomeration of parts to be plated. When tumbling, the electrodes dangle into the agglomeration to provide even current distribution through the various parts forming the agglomeration. The other electrode in the bath may be formed from cobalt or an inert basket containing cobalt. Auxiliary electrodes of graphite may also be employed to create the desired current density at the various parts being plated. The electrodes are energized to create the normal electrolysis between the electrodes and the bath to deposit the alloy containing tin and cobalt onto the tumbling bulk of parts within the rotating barrel. Thereafter, the barrel is removed, rinsed in a water rinse and surfaces of the parts are passivated with a chromic acid solution.

By using this process, screws, bolts, nuts, etc., which are to be coated with a substrate having the appearance of and properties of chromium can be processed in a barrel or bulk process instead of the normal tray type arrangement required for plating such parts in the normal chromium operation.

In accordance with the above example, approximately five minutes are required for each batch of parts.

Having thus described the invention, it is claimed:

1. An aqueous acidic plating bath for electrodeposition of a tarnish resistant alloy onto an electrically conductive substrate, said bath comprises ionic compounds of cobalt, tin and a third metal selected from the class consisting of Periodic Groups IV*b* metals and Periodic V*b* metals and combinations thereof, said ionic compounds being present in ranges of: about 50–350 grams per liter cobalt compounds, about5–45 grams per liter tin compounds, and about 0.2–60 grams per liter third metal compounds.

2. An aqueous acidic bath as defined in claim 1 wherein said cobalt ion producing compound is one or more compounds selected from the class consisting of cobalt chloride, cobalt fluoride, cobalt sulfate, cobalt sulfamate, and cobalt fluoborate.

3. An aqueous acidic bath as defined in claim 1 wherein said tin ion producing compound is one or more compounds selected from the class consisting of stannous chloride, stannous fluoride and stannous fluoborate.

4. An aqueous acidic bath as defined in claim 1 wherein said third metal is a metal selected from the class consisting of vanadium, tantalum, niobium, zirconium, titanium and hafnium.

5. An aqueous acidic bath as defined in claim 4 wherein said third metal ion producing compound is selected from the class consisting of chlorides, fluorides, sulfamates, or fluoborates of said third metals and combinations thereof.

6. An aqueous acidic bath as defined in claim 1 including a compound producing ferric ions.

7. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5–45 grams per liter stannous chloride, about 35–75 grams per liter ammonium bifluoride, about 70–100 grams per liter ammonium chloride, and about 2–60 grams per liter of vanadium fluoride, said bath having a pH in the general range of 1.0–4.2.

8. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5 –45 grams per liter stannous chloride, about 35–75 grams per liter ammonium bifluoride, about 70–100 grams per liter ammonium chloride, and about 0.2–8 grams per liter of tantalum fluoride, said bath having a pH in the general range of 1.0–4.2.

9. An aqueous acidc plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5–45 grams per liter stannous chloride, about 35–75 grams per liter ammonium bifluoride, about 70–100 grams per liter ammonium chloride, and about 1.0–35 grams per liter of zirconium fluoride, said bath having a pH in the general range of 1.0–4.2.

10. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5–45 grams per liter stannous chloride, about 35–75 grams per liter ammonium bifluoride, about 70–100 grams per liter ammonium chloride, and about 2.0–24 grams per liter of niobium fluoride, said bath having a pH in the general range of 1.0–4.2.

11. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt fluoborate, about 5–45 grams per liter stannous chloride, about 35–75 grams per liter ammonium bifluoride, about 70–100 grams per liter ammonium chloride, and about 2–60 grams per liter of vanadium fluoride, said bath having a pH in the general range of 1.0–4.2.

12. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt fluoroborate, about 5–45 grams per liter stannous chloride, about 35–75 grams per liter ammonium bifluoride, about 70–100 grams per liter ammonium chloride, and about 0.2–8 grams per liter of tantalum fluoride, said bath having a pH in the general range of 1.0–4.2.

13. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt fluoborate, about 5–45 grams per liter stannous chloride, about 35–75 grams per liter ammonium bifluoride, about 70–100 grams per liter ammonium chloride, and about 1.0–35 grams per liter of zirconium fluoride, said bath having a pH in the general range of 1.0–4.2.

14. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt fluoborate, about 5–45 grams per liter stannous chloride, about 35–75 grams per liter ammonium bifluoride, about 70–100 grams per liter ammonium chloride, and about 2.0–24 grams per liter of niobium fluoride, said bath having a pH in the general range of 1.0–4.2.

15. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt sulfamate, about 5–45 grams per liter stannous chloride, about 35–75 grams per liter ammonium bifluoride, about 70–100 grams per liter ammonium chloride, and about 2–60 grams per liter of vanadium fluoride, said bath having a pH in the general range of 1.0–4.2.

16. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt sulfamate, about 5–45 grams per liter stannous chloride, about 35–75 grams per liter ammonium bifluoride, about 70–100 grams per liter ammonium chloride, and about 0.2–8 grams per liter of tantalum fluoride, said bath having a pH in the general range of 1.0–4.2.

17. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt sulfamate, about 5–45 grams per liter stannous chloride, about 35–75 grams per liter ammonium bifluoride, about 70–100 grams per liter ammonium chloride, and about 1.0–35 grams per liter of zirconium fluoride, said bath having a pH in the general range of 1.0–4.2.

18. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt sulfamate, about 5–45 grams per liter stannous chloride, about 35–75 grams per liter ammonium bifluoride, about 70–100 grams per liter ammonium chloride, and about 2.0–24 grams per liter of niobium fluoride, said bath having a pH in the general range of 1.0–4.2.

19. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5–45 grams per liter stannous fluoborate, about 35–75 grams per liter ammonium bifluoride, about 70–100 grams per liter ammonium chloride, and about 2–60 grams per liter of vanadium fluoride, said bath having a pH in the general range of 1.0–4.2.

20. An aqueous acidic plating bath for electrodeposition of a tarnish resistant alloy onto an electrically conductive substrate, said bath comprises ionic compounds of cobalt, tin and a third metal selected from class consisting of Periodic Group IV*b* metals and Periodic Group V*b* metals and combinations thereof, said bath including: about 100–350 grams per liter of cobalt chloride, about 5–45 grams per liter stannous fluoborate, about 35–75 grams per liter ammonium bifluoride, about 70–100 grams per liter ammonium chloride, and about 0.2–8 grams per liter of tantalum fluoride, said bath having a pH in the general range of 1.0–4.2.

21. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5–45 grams per liter stannous fluoride, about 35–75 grams per liter ammonium bifluoride, about 70–100 grams per liter ammonium chloride, and about 1.0–35 grams per liter of zirconium fluoride, said bath having a pH in the general range of 1.0–4.2.

22. An aqueous acidic plating bath for electrodeposition of a tarnish resistant alloy onto an electrically conductive substrate, said bath comprises ionic compounds of cobalt, tin and a third metal selected from the class consisting of Periodic Group IV*b* metals and Periodic Group V*b* metals and combinations thereof, said bath including: about 100–350 grams per liter of cobalt chloride, about 5–45 grams per liter stannous fluoborate, about 35–75 grams per liter ammonium bifluoride, about 70–100 grams per liter ammonium chloride, and about 2.0–24 grams per liter of niobium fluoride, said bath having a pH in the general range of 1.0–4.2.

23. A method for bulk plating of the outer surface of small parts forming a randomly-oriented agglomeration, wherein each dimension of said agglomeration of parts is substantially greater than any dimension of the constituent parts of said agglomeration, said parts of said agglomeration being freely movable relative to each other when said agglomeration is tumbled, said method comprising the steps of:

a. placing said agglomeration of parts in a plating barrel;

b. placing said barrel into an aqueous acidic bath including dissociated ionic compounds of tin, cobalt, and a third metal from Periodic Groups IV*b* and V*b*, said ionic compounds being present in the bath in the ranges of about 50—350 grams per liter cobalt compounds, about 5–45 grams per liter tin compounds and about 0.2–60 grams per liter third metal compounds:

c. placing a first electrode into said agglomeration of parts;

d. placing a second electrode into said bath;

e. energizing said electrodes to plate an alloy onto said surfaces of said small parts; and, f. rotating said barrel during said energizing step.

24. A method as defined in claim 23 including the initial step of plating bright metal substrate coating onto said surfaces of said parts.

25. A method as defined in claim 23 including:

g. placing at least two first electrodes into said agglomeration.

26. A method for depositing a bright tarnish resistant coating on a part having an electrically conductive substrate, comprising the steps of:

a. placing said parts in an aqueous acid bath containing dissociated ionic compounds of cobalt, tin and a third metal selected from a class consisting of Periodic Group IV*b* and Group V*b* metals, said ionic compounds being present in the bath in the ranges of about 50–350 grams per liter cobalt compounds, about 5–45 grams per liter tin compounds and about 0.2–60 grams per liter third metal compounds.

b. electrically connecting said part to a first electrode;

c. placing a second electrode in said bath, and d. energizing said first and second electrodes with a D.C. voltage to deposit an alloy on said part.

* * * * *